US007416519B2

(12) United States Patent
Heck

(10) Patent No.: US 7,416,519 B2
(45) Date of Patent: Aug. 26, 2008

(54) MASSAGE AND RESISTANCE TRAINING APPARATUS AND METHOD

(76) Inventor: Robert W. Heck, 4990 Heuga Ct., Park City, UT (US) 84098

( * ) Notice: Subject to any disclaimer, the term of this patent is extended or adjusted under 35 U.S.C. 154(b) by 517 days.

(21) Appl. No.: 10/895,637

(22) Filed: Jul. 20, 2004

(65) Prior Publication Data

US 2006/0019805 A1 Jan. 26, 2006

(51) Int. Cl.
*A63B 21/02* (2006.01)

(52) U.S. Cl. ..... 482/121; 482/122; 601/71; D24/215

(58) Field of Classification Search ..... 482/57, 482/97, 121–124, 133, 148, 54; 601/71, 601/132, 133, 143–145, 147, DIG. 14; D24/215
See application file for complete search history.

(56) References Cited

U.S. PATENT DOCUMENTS

| | | | | | |
|---|---|---|---|---|---|
| 1,250,118 | A | | 12/1917 | Flynt | |
| 1,507,554 | A | | 9/1924 | Cooper | |
| 1,702,991 | A | | 2/1929 | Bechmann | |
| 1,730,687 | A | * | 10/1929 | Riley | 601/147 |
| 1,747,372 | A | | 2/1930 | Luehrmann | |
| 1,805,853 | A | | 5/1931 | Smith | |
| 1,807,308 | A | | 5/1931 | Remer | |
| 1,919,062 | A | * | 7/1933 | Haynes | 601/143 |
| 2,980,109 | A | * | 4/1961 | Schein | 601/145 |
| 3,344,783 | A | * | 10/1967 | Stoll | 601/145 |
| 3,915,159 | A | | 10/1975 | Simjian | |
| 3,960,144 | A | | 6/1976 | Simjian | |
| 4,991,568 | A | * | 2/1991 | Lin | 601/101 |
| 5,158,075 | A | * | 10/1992 | Howard | 601/79 |
| 5,192,257 | A | * | 3/1993 | Panasewicz | 482/70 |
| 5,234,392 | A | * | 8/1993 | Clark | 482/54 |
| 5,609,566 | A | * | 3/1997 | Pupovic | 601/23 |
| 6,383,154 | B1 | * | 5/2002 | Chang | 601/145 |
| 6,443,876 | B1 | * | 9/2002 | Huang | 482/54 |
| 7,087,029 | B2 | * | 8/2006 | Friedland | 601/72 |

* cited by examiner

*Primary Examiner*—Jerome Donnelly
*Assistant Examiner*—Tam Nguyen
(74) *Attorney, Agent, or Firm*—Thorpe North Western, LLP

(57) ABSTRACT

A resistance training and massage apparatus simultaneously provides resistance training and massage. A vibrating strap is formed into a loop to extend around a body portion of a user. The strap is displaceable as the user exerts a pulling force on the strap. A motor is coupled to the strap and displaceable along with the strap as the user exerts a pulling force on the strap. The motor imparts vibration to the strap. Resistance means is coupled to the motor for elastically resisting displacement of the motor and the strap, and providing a resistance force to the pulling force exerted by the user.

20 Claims, 4 Drawing Sheets

MASSAGE AND RESISTANCE TRAINING APPARATUS AND METHOD

BACKGROUND OF THE INVENTION

1. Field of the Invention

The present invention relates generally to resistance training and cellulite reduction.

2. Related Art

Fat deposition on the back, thighs, buttocks, and abdomen often has a dimpled appearance. This type of fat has been coined "cellulite," and has been a cosmetic challenge for both heavy and thin people for decades. Scientists, doctors, and entrepreneurs around the world have been trying to develop a solution for years.

Millions of research, development and consumer dollars have been spent on various creams and lotions purported to dissolve cellulite. The scientific support for and the results from studies on these products are often lacking, but the public continues to purchase them. Often, misleading information from the manufacturers and ignorance on the part of consumers leads to poor results and discontent. Marketers attempt to convince the public that their product works. But what they fail to disclose is that the user must apply this cream or lotion daily, and do so using deep massage.

There may be a valid reason why these creams or lotions work well for some, and not at all for others. The trick and secret may have to do with the method of application, and not necessarily the make up of the cream or lotion. If the cream or lotion is applied in the normal fashion of a lotion, with light pressure, the results are likely to be poor. There may be some increase of circulation to the skin caused by the product itself, but it is unlikely to permeate the fat cells. Thus, one should not expect any alteration in the fat that lies deep below the skin. If, however, the cream is applied with deep massage, more blood will be summoned to the skin, subcutaneous tissue, and fat layer. The increase in circulation caused by massage actually helps to mobilize fatty cells which could potentially "spot reduce" fat. Further, deep massage can mechanically break down the septations between the fatty pockets in cellulite. These fatty pockets are what cause the dimpled appearance of cellulite. Liposuction is a surgical procedure for spot reduction of fat. Liposuction not only mechanically removes fat globules, but also breaks down the septations which surround the fatty globules. Unfortunately, this procedure is not only very painful, but fraught with potential complications. Scarring can occur from the incisions and adhesion within the fatty layer, thus worsening, rather than improving the look of the fatty area. In addition, this procedure is very operator dependent. Therefore, results can vary significantly.

There are three proven methods known to eliminate cellulite which are safe, non-invasive, and effective—diet, exercise, and massage. Almost any diet can be used as long as the end result is a decrease in the total amount of body fat. By decreasing the total body fat, one can decrease the amount of cellulite. Since the fat should not and cannot be completely removed and the septations remain intact, this method just reduces the volume of cellulite. Once the weight is added back on, the cellulite puckers up again. Fat reduction alone, through diet and exercise can eliminate approximately 90% of the problem. The remaining 10%, and the reason that some "skinny" people still have cellulite, can be due to septations. A certain amount of body fat is healthy, and losing the extra 10% may require many people to take extreme and unhealthy measures to completely eliminate cellulite. Not only would it be unhealthy, but it can require prolonged discipline that can take the joy out of life, and can be difficult to sustain long term.

Exercise also helps in the elimination of cellulite. Exercise can increase the number of calories burned, which decreases further deposition of fat. The only way to reduce pre-existing fat is to run a calorie deficit. This means that a person must burn more calories than he or she has available for fuel. Fat is only broken down to provide the extra calories needed when there is not enough food in the digestive tract.

Progressive resistance training (PRT) provides additional benefits to the exerciser in pursuit of fat reduction by increasing muscle mass. The increase in muscle mass uses more energy (calories) at rest. Thus, those with more muscle mass can eat more than average and maintain lower body fat. An added benefit of PRT is that increased muscle bulk in the hamstrings and gluteal region will by virtue of physics decrease the presence and appearance of cellulite. The skin and fat are "pushed away" and stretched over the increased muscle bulk resulting in smoother skin and subcutaneous fat.

Finally, there are a few outcome studies that show clear clinical improvement of cellulite after a course of massage. The challenge is that massage works best if done for at least 30 minutes every other day, and once stopped, the results fade. Massage can often become very expensive and time consuming. A device has been developed just for cellulite massage, but it requires a trained professional to operate, and is typically only available in clinics.

SUMMARY OF THE INVENTION

It has been recognized that it would be advantageous to develop an apparatus and method for reducing fat, cellulite and/or the look of cellulite.

The invention provides a resistance training and massage apparatus to simultaneously provide resistance training and massage. A strap is formed into a loop to extend around a body portion of a user. The strap is displaceable as the user exerts a pulling force on the strap. A motor or vibration means is coupled to the strap to impart vibration to the strap. The motor is displaceable along with the strap as the user exerts a pulling force on the strap. A resistance means is coupled to the motor for elastically resisting displacement of the motor and the strap, and providing a resistance force to the pulling force exerted by the user.

The invention also provides a method for simultaneously performing resistance training and receiving massage. A vibrating strap is looped around a body portion of a user, the strap being coupled to a motor that vibrates the strap. The user pulls against the strap and elastically displaces the strap, the strap being coupled to a resistance force to elastically resist a pulling force exerted by the user.

Additional features and advantages of the invention will be apparent from the detailed description which follows, taken in conjunction with the accompanying drawings, which together illustrate, by way of example, features of the invention.

DETAILED DESCRIPTION

Figure 1:
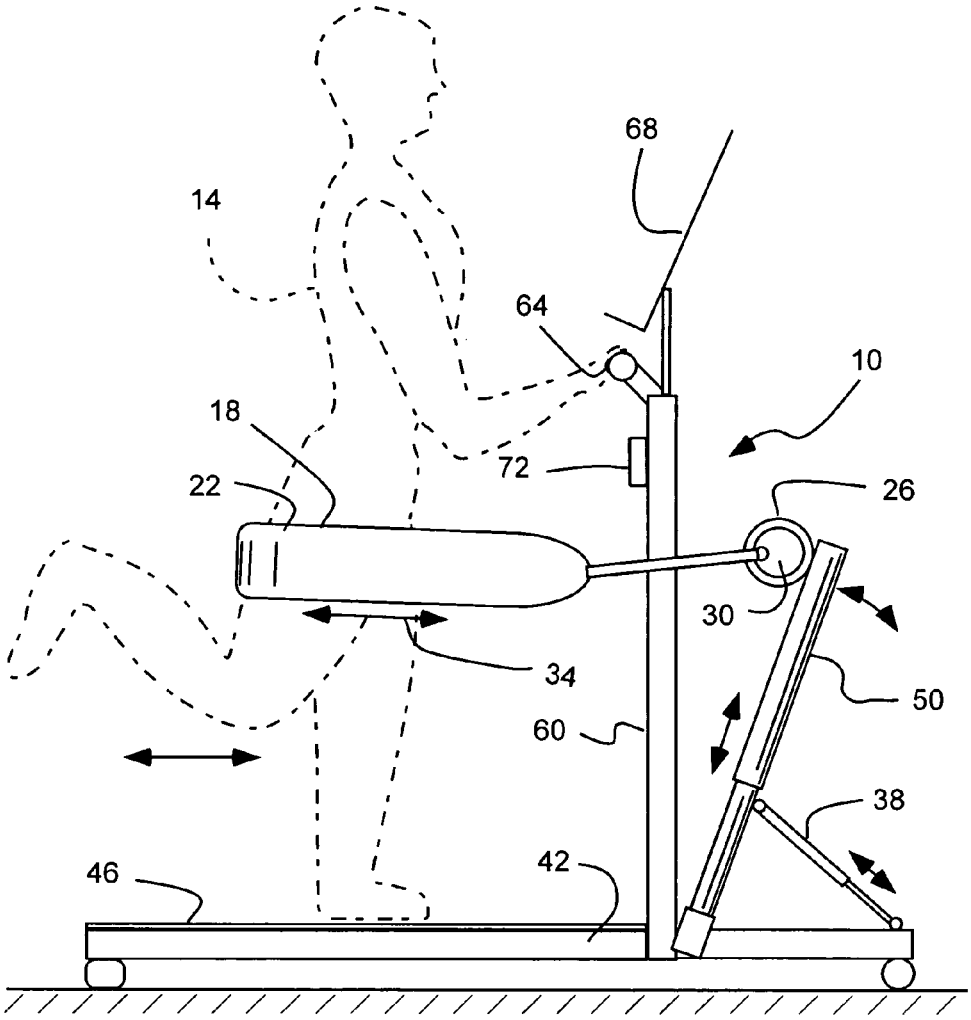
FIG. 1 is a side view of a resistance training and massage apparatus in accordance with an embodiment of the present invention.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

Figure 2:
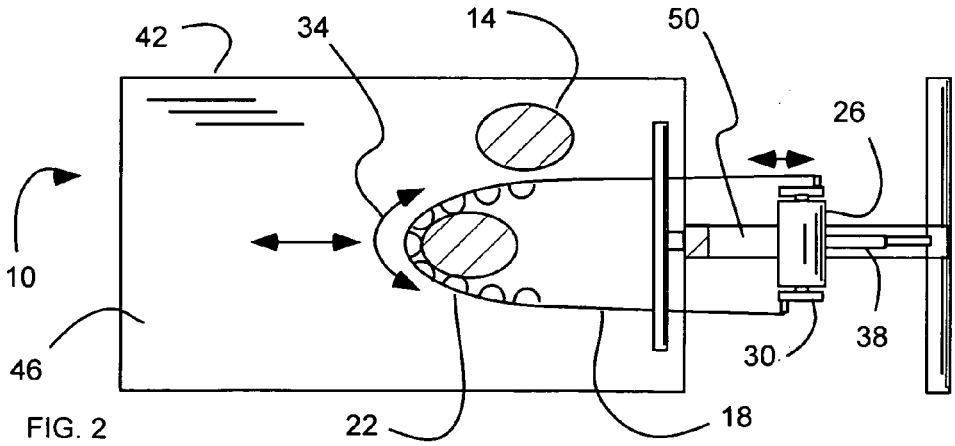
FIG. 2 is a partial cross-sectional top view of the apparatus of FIG. 1.
Figure 3:
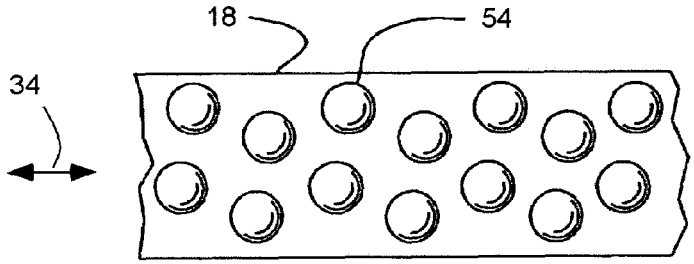
FIG. 3 is a partial side view of a strap of the apparatus of FIG. 1.

As illustrated in FIGS. 1-3, a resistance training and massage apparatus, indicated generally at 10, in accordance with the present invention is shown for simultaneously providing resistance training and massage to a user 14 in an effort to reduce cellulite, or to cosmetically alter cellulite. It is believed that progressive resistance training and massage reduce cellulite. The apparatus 10 provides "active," self administered, deep massage while training the hamstrings and gluteal muscles. It is believed that the deep massage helps to break down the septations between the fat pockets, thus eliminating the dimpled appearance of cellulite. The massage, in combination with the vibration and muscle contraction, causes dramatic increase in blood flow to the skin, subcutaneous tissue, and fat, resulting in active mobilization of fat cells. Therefore, the apparatus 10 advantageously provides both massage and resistance training simultaneously in an effort to reduce cellulite or the appearance of cellulite.

The massage is applied with a strap 18 configured to vibrate and/or oscillate a portion of the user's body, such as the user's waist, buttocks and/or thighs. The strap 18 can be formed into a loop 22 extending around the user's body portion. For example, the loop 22 can extend around the user's thigh, as shown in FIG. 1. The terms "vibrate" and "oscillate" are used interchangeably herein to refer broadly to movement of the strap 18, including vibration, oscillation, etc. A motor 26 can be operatively coupled to the strap 18 to vibrate and/or oscillate the strap. The strap 18 can be elongated and can have distal ends. The motor 26 can have dual shafts with flywheels 30 disposed on both shafts. The distal ends of the strap can be coupled to opposite flywheels 30, and to opposite eccentric positions on the flywheels 30. Thus, as the motor 26 rotates, the strap is caused to oscillate, as indicated by arrow 34. The motor 26 can be an electrical motor with variable speeds. The motor 26 is one example of vibration means for imparting vibration to the strap. Other vibration means can include, for example, motors with off-balance shafts or weights, linear motors, etc.

Figure 1B:
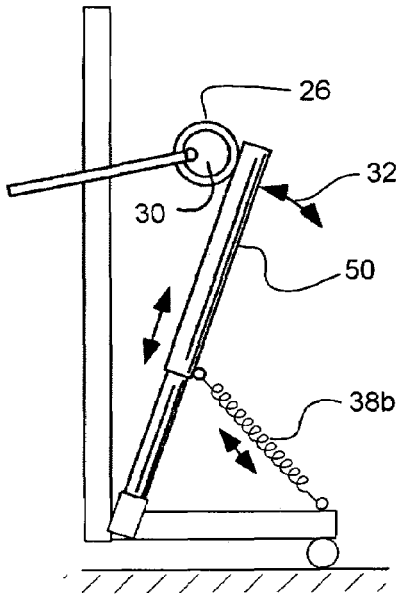
FIG. 1*b* is a partial side view of another resistance training and massage apparatus in accordance with an embodiment of the present invention.
Figure 1C:
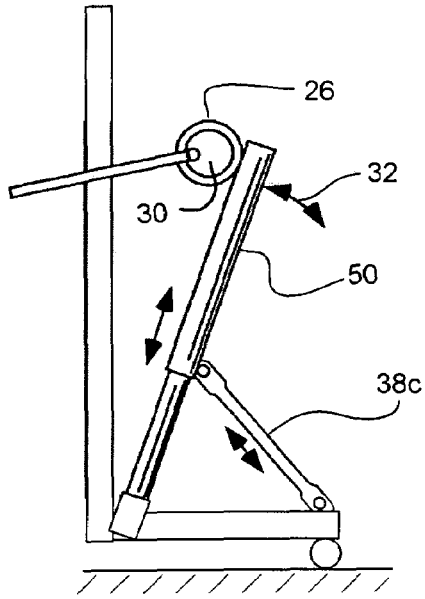
FIG. 1*c* is a partial side view of another resistance training and massage apparatus in accordance with an embodiment of the present invention.
Figure 1D:
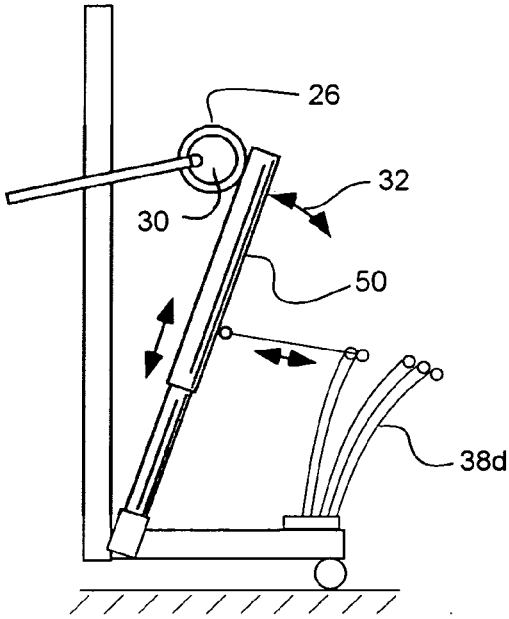
FIG. 1*d* is a partial side view of another resistance training and massage apparatus in accordance with an embodiment of the present invention.
Figure 1E:
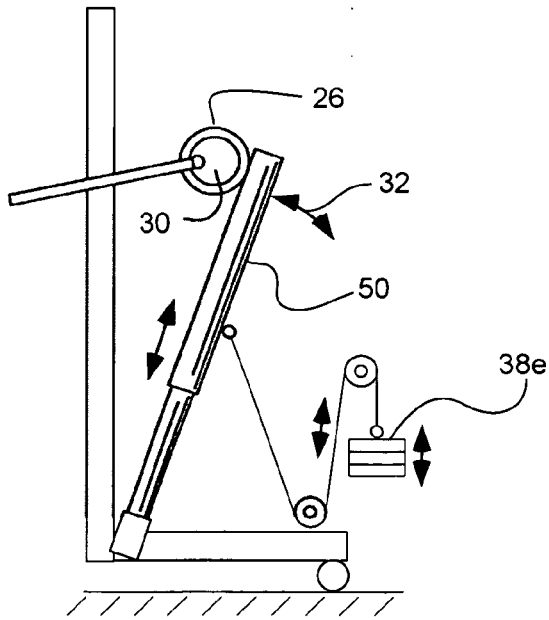
FIG. 1*e* is a partial side view of another resistance training and massage apparatus in accordance with an embodiment of the present invention.

The resistance training is provided by elastically displacing the strap 18. Thus, the strap 18 is horizontally displaceable as the user 14 repeatedly exerts a pulling force 16 on the strap. For example, the strap or loop can extend around the user's leg or thigh, and the user can repeatedly pull the strap backwardly or rearwardly, as shown in FIGS. 1 and 2. The motor 26 also can be displaceable along with the strap as the user exerts the pulling force 16 on the strap. A resistance force is provided to the pulling force of the user. The resistance force can be provided by a gas shock 38 coupled to the motor. The gas shock 38 can include a piston movably disposed in a cylinder to define a chamber therein. As the piston is drawn away from the chamber, the volume decreases and creates a negative pressure that resists displacement of the piston. The gas shock 38 is one example of a resistance means for elastically resisting displacement of the motor and the strap, and providing a resistance force to the pulling force exerted by the user. Other resistance means can include, for example, coil springs (38*b* in FIG. 1*b*), leaf springs (38*d* in FIG. 1*d*), elastic members (38*c* in FIG. 1*c*), air shocks, weights (38*e* in FIG. 1*e*), etc. In addition, the resistance means can be adjustable for providing a variable resistance force to the pulling force exerted by the user. For example, the resistance force can be adjusted by adjustable valves for air shocks 36, adjustable couplings of springs or elastic members, or pulley systems for weights, etc. Furthermore, the strap 18 can include an elastic strap capable of elastic deformation as the user exerts a pulling force. The strap 18 itself can be elastic, or a portion of the strap 18 can include an elastic portion.

Therefore, the motor 26 and the strap 18 can provide massage simultaneously while the user performs resistance training by repeatedly pulling 16 against the resistance means and relaxing the strap.

The apparatus 10 can include a base 42 with a platform 46 to support the user 14. An arm 50 can be movably or pivotally coupled to the base 42, and can carry the motor 26. A first end of the arm 50 can be pivotally coupled to the base 42, while the motor can be mounted to a second end of the arm. The gas shock 38 or resistance means can be coupled between the base and the arm. The position(s) of the connection between the gas shock and the arm 50 and/or base 42 can be moved or adjusted to change the resistance force provided by the gas shock.

The arm 50 can have an adjustable length to change or adjust an elevation of the motor 26. Thus, the elevation of the strap 18 can be adjusted to suit the user's body, and/or position the strap where needed. For example, the arm 50 can include first and second portions movably coupled together, or telescoping portions. The two portions can be selectively fixed with respect to one another by a pin selectively disposable in an array of apertures in the portions.

Referring to FIG. 3, the strap 18 can include a plurality of protrusions 54 extending inwardly with respect to the loop 22. The protrusions 54 can help provide a deeper massage by creating concentration points for the force and vibration against the user's body. The protrusions 54 can be flexible and resilient.

Figure 4:
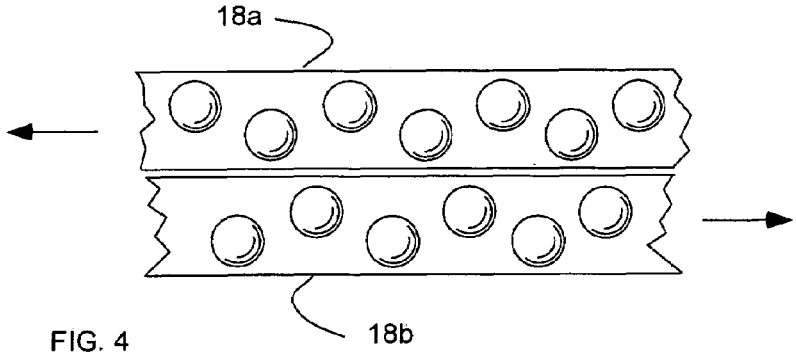
FIG. 4 is a partial side view of another strap in accordance with an embodiment of the present invention.
Figure 5:
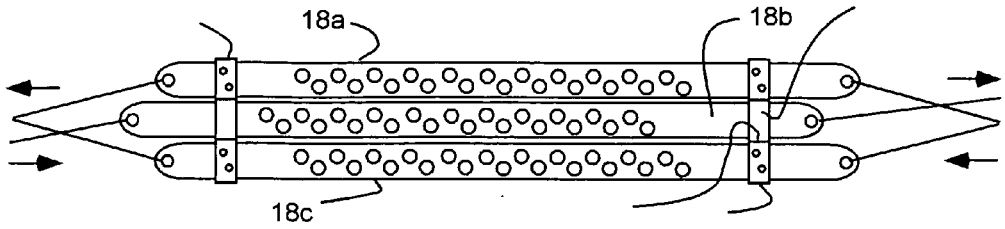
FIG. 5 is front view of another strap in accordance with an embodiment of the present invention.
Figure 6:
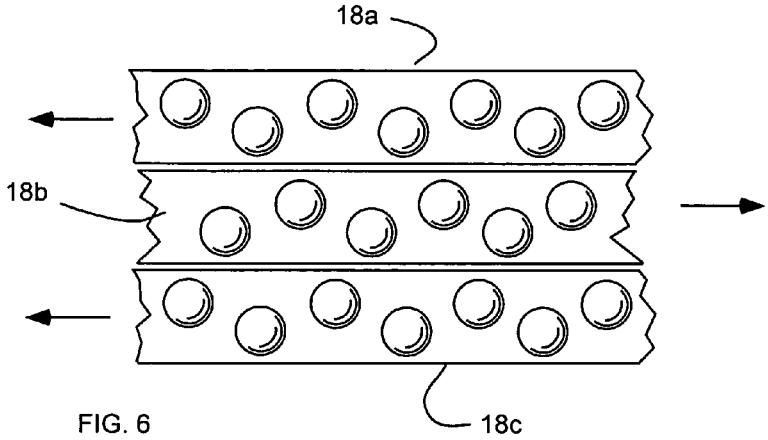
FIG. 6 is a partial front view of the strap of FIG. 5.

Referring to FIG. 4, another strap is shown that includes two straps 18*a* and 18*b* that move or oscillate in different directions, or in opposite directions of one another. Referring to FIG. 5, another strap is shown that includes three straps

Figure 7:
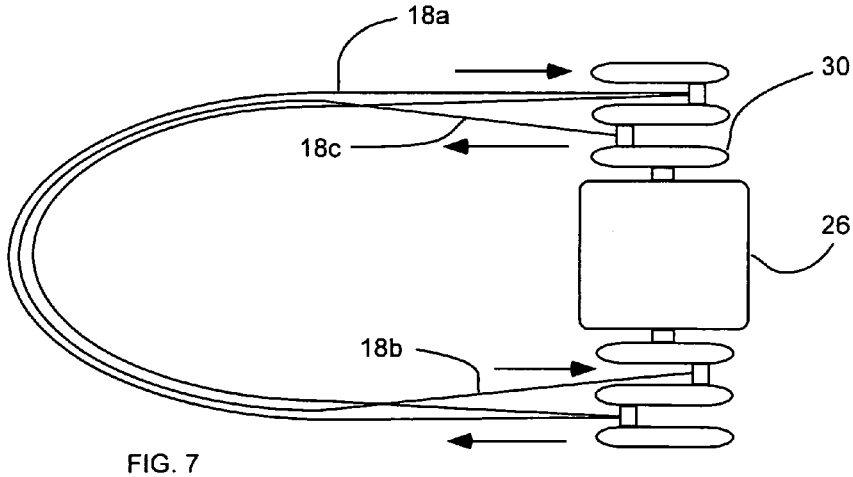
FIG. 7 is a top schematic view of the strap of FIG. 5.

18*a*, 18*b* and 18*c*. The upper and lower straps 18*a* and 18*c* can move in the same direction, while the middle strap 18*b* moves opposite to the other straps. The opposite movement of the straps can provide a more invigorating massage. The opposite motion can be obtained by coupling the corresponding ends of the straps to different locations on the flywheels 30 having opposing eccentricities, as shown schematically in FIG. 7. The flywheels 30 can include dual flywheels on each side of the motor, each wheel of the dual flywheel having a different connection point with opposing eccentricities for the strap. Thus, as the flywheel rotates, the straps move in different directions.

The base 42 can include a vertical column 60 with a grip or handle 64 to allow the user to stabilize himself or herself. A stand 68 can be disposed on the column 60 to receive a book, magazine, television screen or monitor, etc. A timer 72 can also be carried by the column to allow the user to time the exercise and massage.

Figure 8:
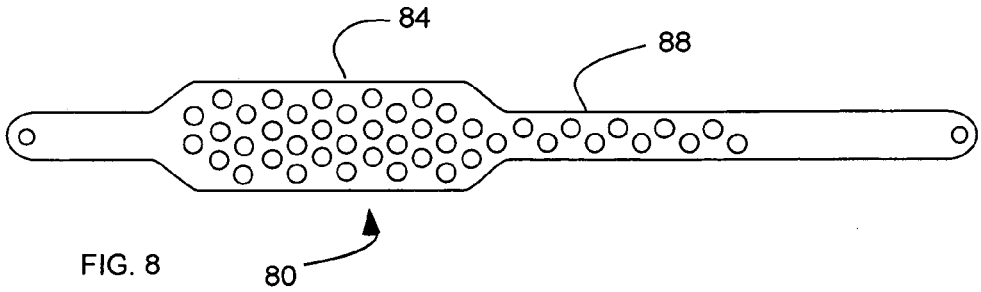
FIG. 8 is a front view of another strap in accordance with an embodiment of the present invention.
Figure 9:
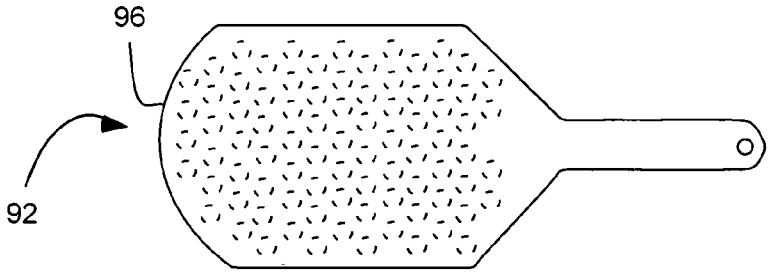
FIG. 9 is a side view of another strap in accordance with an embodiment of the present invention.

Different straps can be provided that are configured or shaped for different parts of the body. For example, a thigh strap 80 can have a wider or taller section 84 on one side, and a narrower or shorter section 88 on the other side, as shown in FIG. 8. Thus, the narrower or shorter section 88 can be positioned between the user's leg without causing undue discomfort, while the wider or taller section 84 can cover a greater surface of the user's skin on the back, outside and/or front of the user's thigh or hip. As another example, a buttocks strap 92 can have a curved or cupped portion 96 configured to receive the user's buttocks therein, and maximize coverage of the user's buttocks.

A method for using the apparatus 10 described above, and for simultaneously performing resistance training and receiving massage, includes looping the vibrating strap 18 around a body portion of the user 14, with the strap being coupled to the motor 26 to vibrate the strap. The strap 18 can be looped around the waist, buttocks or thigh of the user. The user 14 pulls against the strap 18 and elastically displaces the strap, with the strap coupled to a resistance force to elastically resist the pulling force exerted by the user. The user 14 can repeatedly pull against the strap, and relax the strap.

An elevational height of the strap 18 and the motor 26 can be adjusted to correspond to the waist, buttocks or thigh of the user 14.

The user can implement an exercise/massage regimen that includes regular use of the apparatus. For example, the user can exercise/massage for 20-30 minutes a day, 3-5 times a week.

The base or frame 42 and vertical column 60 can be formed of metal, such as tubular steel or aluminum cut or bent to form the desired shape, and welded together or to other components. The platform 46 can be metal or plastic, and can include a non-skid or non-slip surface. It is of course understood that the base or frame can have other configurations. The arm 50 can be formed of telescoping steel or aluminum tubes, and can be adjustable by a series of holes and a locking pin. The resistance means can be coupled to the arm and/or base by a pin inserted through apertures in brackets and the resistance means and the base. The resistance means can be adjustably coupled by using a series of apertures.

It is to be understood that the above-referenced arrangements are illustrative of the application for the principles of the present invention. It will be apparent to those of ordinary skill in the art that numerous modifications can be made without departing from the principles and concepts of the invention as set forth in the claims.

What is claimed is:

1. A resistance training and massage apparatus configured to simultaneously provide resistance training and massage, the apparatus comprising:

a) a strap formed into a loop configured to extend around a body portion of a user, and displaceable substantially horizontally as the user exerts a pulling force on the strap;

b) a motor, coupled to the strap and displaceable along with the strap as the user exerts the pulling force on the strap, the motor being configured to impart vibration to the strap; and c) a base having a platform;

d) an arm having one end movably coupled to the base and the other end coupled to the motor; and e) a resistance means, coupled to the motor, for resisting displacement of the motor and the strap, and providing a resistance force to the pulling force exerted by the user wherein the resistance means is interconnected between the base and the arm.

2. An apparatus in accordance with claim 1, wherein the arm has an adjustable length to change an elevation of the motor relative to the base.

3. An apparatus in accordance with claim 1, wherein the resistance means is selected from the group consisting of: a coil spring, a leaf spring, an elastic member, an air shock, and a weight.

4. An apparatus in accordance with claim 1, wherein the resistance means is adjustable for providing a variable resistance force to the pulling force exerted by the user.

5. An apparatus in accordance with claim 1, wherein the strap further comprises at least two straps coupled to the motor to vibrate in different directions.

6. An apparatus in accordance with claim 5, further comprising:

a) a pair of flywheels, coupled to each end of the motor;

b) the at least two straps having corresponding ends coupled to the flywheels at different locations having different eccentricities; and c) the motor rotating the flywheels to oscillate the strap.

7. An apparatus in accordance with claim 1, wherein the strap includes an elastic strap capable of elastic deformation as the user exerts a pulling force.

8. An apparatus in accordance with claim 1, wherein the strap includes a plurality of protrusions extending inwardly with respect to the loop.

9. An apparatus in accordance with claim 1, further comprising:

a) a pair of flywheels, coupled to the motor;

b) the strap being coupled to the flywheels; and c) the motor rotating the flywheels to oscillate the strap.

10. A resistance training and massage apparatus, comprising:

a) a base having a platform;

b) a motor, supported by the base, and displaceable with respect to the base;

c) a resistance means, coupled between the base and the motor, for resisting displacement of the motor, and providing a resistance force to a pulling force exerted by a user;

d) a strap, coupled to the motor, and forming a loop configured to extend around a body portion of the user, the strap and the motor being displaceable together; and e) a pivot arm wherein one end of the arm is pivotally coupled to the base, the other end of the arm carries the motor, the motor is configured to cause the strap to oscillate or vibrate and the resistance means is interconnected between the base and the pivot arm.

11. An apparatus in accordance with claim 10, wherein the pivot arm has an adjustable length to change an elevation of the motor relative to the base.

12. An apparatus in accordance with claim 10, wherein the resistance means is selected from the group consisting of: a coil spring, a leaf spring, an elastic member, an air shock, and a weight.

13. An apparatus in accordance with claim 10, wherein the resistance means is adjustable for providing a variable resistance force to a pulling force exerted by the user.

14. An apparatus in accordance with claim 10, wherein the strap further comprises at least two straps coupled to the motor to vibrate in different directions.

15. An apparatus in accordance with claim 14, further comprising:

a) a pair of flywheels, coupled to each end of the motor;

b) the at least two straps having corresponding ends coupled to the flywheels at different locations having different eccentricities; and c) the motor rotating the flywheels to oscillate the strap.

16. An apparatus in accordance with claim 10, wherein the strap includes an elastic strap capable of elastic deformation as the user exerts a pulling force.

17. An apparatus in accordance with claim 10, wherein the strap includes a plurality of protrusions extending inwardly with respect to the loop.

18. An apparatus in accordance with claim 10, further comprising:

a) a pair of flywheels, coupled to the motor;

b) the strap being coupled to the flywheels; and c) the motor rotating the flywheels to oscillate the strap.

19. A resistance training and massage apparatus, comprising:

a) a strap formed into a loop configured to extend around a body portion of a user and displaceable as the user exerts a pulling force on the strap;

b) a vibration means, coupled to the strap, for imparting vibration to the strap, and capable of being displaced as the user exerts the pulling force on the strap;

c) a resistance means, coupled to the vibration means, for elastically resisting displacement of the vibration means, and providing a resistance force to the pulling force exerted by the user;

d) a base with a platform configured to receive the user thereon and a column extending upwardly; and e) an arm having one end movably coupled to the base and an opposite end coupled to the vibrations means which includes a motor wherein the strap is coupled to the motor such that the strap and the motor are displaceable together and the resistance means is interconnected between the base and the arm.

20. An apparatus in accordance with claim 19, wherein the resistance means and the strap include an elastic strap.

* * * * *